US012179244B2

(12) United States Patent
Matsui et al.

(10) Patent No.: US 12,179,244 B2
(45) Date of Patent: Dec. 31, 2024

(54) CONTROL DEVICE FOR ROLLING MILL APPARATUS, ROLLING MILL FACILITY, AND OPERATION METHOD FOR ROLLING MILL APPARATUS

(71) Applicant: PRIMETALS TECHNOLOGIES JAPAN, LTD., Hiroshima (JP)

(72) Inventors: Yoichi Matsui, Hiroshima (JP); Yuta Odawara, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 170 days.

(21) Appl. No.: 17/913,349

(22) PCT Filed: Aug. 12, 2020

(86) PCT No.: PCT/JP2020/030695

§ 371 (c)(1),
(2) Date: Sep. 21, 2022

(87) PCT Pub. No.: WO2022/034654

PCT Pub. Date: Feb. 17, 2022

(65) Prior Publication Data

US 2023/0115961 A1 Apr. 13, 2023

(51) Int. Cl.

| | |
|---|---|
| ***B21B 37/48*** | (2006.01) |
| ***B21B 27/10*** | (2006.01) |
| ***B21B 37/00*** | (2006.01) |
| ***B21B 37/32*** | (2006.01) |
| ***B21B 37/38*** | (2006.01) |

(Continued)

(52) U.S. Cl.
CPC ..... *B21B 37/48* (2013.01)

(58) Field of Classification Search
CPC ..... B21B 37/48; B21B 37/46; B21B 37/00; B21B 38/00; B21B 2275/06
See application file for complete search history.

(56) References Cited

FOREIGN PATENT DOCUMENTS

| | | | |
|---|---|---|---|
| JP | 59-33006 A | | 2/1984 |
| JP | S5933006 A | * | 2/1984 |

(Continued)

OTHER PUBLICATIONS

English translate (JPS5933006A), retrieved date May 2, 2024.*

(Continued)

*Primary Examiner* — Matthew Katcoff
*Assistant Examiner* — Mohammed S. Alawadi
(74) *Attorney, Agent, or Firm* — Birch, Stewart, Kolasch & Birch, LLP

(57) ABSTRACT

A control device for a rolling mill apparatus including at least one rolling mill stand for rolling a metal plate includes: a detection signal acquisition part for receiving, from an edge crack sensor, a detection signal of an edge crack at an end portion of the metal plate in a plate width direction; and a rolling condition decision part for deciding a rolling condition for the rolling mill apparatus. The rolling condition decision part is configured to change, if the detection signal acquisition part receives the detection signal of the edge crack, the rolling condition for the rolling mill apparatus from a first rolling condition immediately before detection of the edge crack to a second rolling condition which is more capable of suppressing growth of the edge crack than the first rolling condition.

12 Claims, 8 Drawing Sheets

(51) Int. Cl.

| | |
|---|---|
| ***B21B 37/40*** | (2006.01) |
| ***B21B 37/46*** | (2006.01) |
| ***B21B 38/00*** | (2006.01) |

(56) References Cited

FOREIGN PATENT DOCUMENTS

| | | | | |
|---|---|---|---|---|
| JP | 4-200904 | A | | 7/1992 |
| JP | H04200904 | A | * | 7/1992 |
| JP | 9-89809 | A | | 4/1997 |
| JP | H0989809 | A | * | 4/1997 |
| JP | 2000-171411 | A | | 6/2000 |
| JP | 2006-224119 | A | | 8/2006 |
| JP | 2010-221259 | A | | 10/2010 |
| JP | 2019-111571 | A | | 7/2019 |

OTHER PUBLICATIONS

English translate (JPH0989809A), retrieved date May 2, 2024.*
English translate (JPH04200904A), retrieved date May 3, 2024.*
Extended European Search Report for European Application No. 20949516.7, dated Apr. 24, 2023.
International Search Report (PCT/ISA/210) issued in PCT/JP2020/030695 mailed on Sep. 29, 2020.
Written Opinion (PCT/ISA/237) issued in PCT/JP2020/030695 mailed on Sep. 29, 2020.
International Preliminary Report on Patentability and English translation of the Written Opinion of the International Searching Authority for International Application No. PCT/JP2020/030695, dated Feb. 23, 2023.

* cited by examiner

CONTROL DEVICE FOR ROLLING MILL APPARATUS, ROLLING MILL FACILITY, AND OPERATION METHOD FOR ROLLING MILL APPARATUS

TECHNICAL FIELD

The present disclosure relates to a control device for a rolling mill apparatus, a rolling mill facility, and an operation method for a rolling mill apparatus.

BACKGROUND ART

In the process of producing a metal plate, an edge crack may be formed at an end portion of the metal plate in the plate-width direction. It is necessary to detect an edge crack appropriately since growth of an edge rack may lead to breakage of the metal plate.

Patent Document 1 discloses a technique to detect an edge crack of a steel plate using an edge profile meter disposed on the output side of the rolling mill process line. Accordingly, breakage of the metal plate is prevented in the processing process step (e.g., continuous annealing step) at the downstream side of the rolling mill process line.

CITATION LIST

Patent Literature

Patent Document 1: JPH9-89809A

SUMMARY

Problems to be Solved

Meanwhile, an edge crack grows during mill rolling of a metal plate, and breakage of the metal plate may occur. In this regard, the technique disclosed in Patent Document 1 only detects an edge crack in the mill rolling line, and is not capable of suppressing growth of an edge crack during mill rolling or breakage of the metal plate due to the growth.

In view of the above, an object of at least one embodiment of the present invention is to provide a control device for a rolling mill apparatus, a rolling mill facility, and an operation method for a rolling mill apparatus capable of suppressing growth of an edge crack during mill rolling.

Solution to the Problems

According to at least one embodiment of the present invention, a control device for a rolling mill apparatus including at least one rolling mill stand for rolling a metal plate, includes: a detection signal acquisition part for receiving, from an edge crack sensor, a detection signal of an edge crack at an end portion of the metal plate in a plate width direction; and a rolling condition decision part for deciding a rolling condition for the rolling mill apparatus. The rolling condition decision part is configured to change, if the detection signal acquisition part receives the detection signal of the edge crack, the rolling condition for the rolling mill apparatus from a first rolling condition immediately before detection of the edge crack to a second rolling condition which is more capable of suppressing growth of the edge crack than the first rolling condition.

Furthermore, according to at least one embodiment of the present invention, a rolling mill facility includes: a rolling mill apparatus including at least one rolling mill stand for rolling a metal plate; an edge crack sensor configured to detect an edge crack at an end portion of the metal plate in a plate width direction during rolling by the rolling mill apparatus; and the above described control device configured to control the rolling mill apparatus on the basis of a detection signal from the edge crack sensor.

Furthermore, according to at least one embodiment of the present invention, a method of operating a rolling mill apparatus including at least one rolling mill stand includes: a step of rolling a metal plate using the rolling mill apparatus; a step of detecting an edge crack at an end portion of the metal plate in a plate width direction during rolling by the rolling mill apparatus; and a step of changing, if the edge crack of the metal plate is detected, a rolling condition for the rolling mill apparatus from a first rolling condition immediately before detection of the edge crack to a second rolling condition which is more capable of suppressing growth of the edge crack than the first rolling condition.

Advantageous Effects

According to at least one embodiment of the present invention, it is possible to provide a control device for a rolling mill apparatus, a rolling mill facility, and an operation method for a rolling mill apparatus capable of suppressing an edge crack during mill rolling.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

(Configuration of Rolling Mill Facility)

Figure 1:
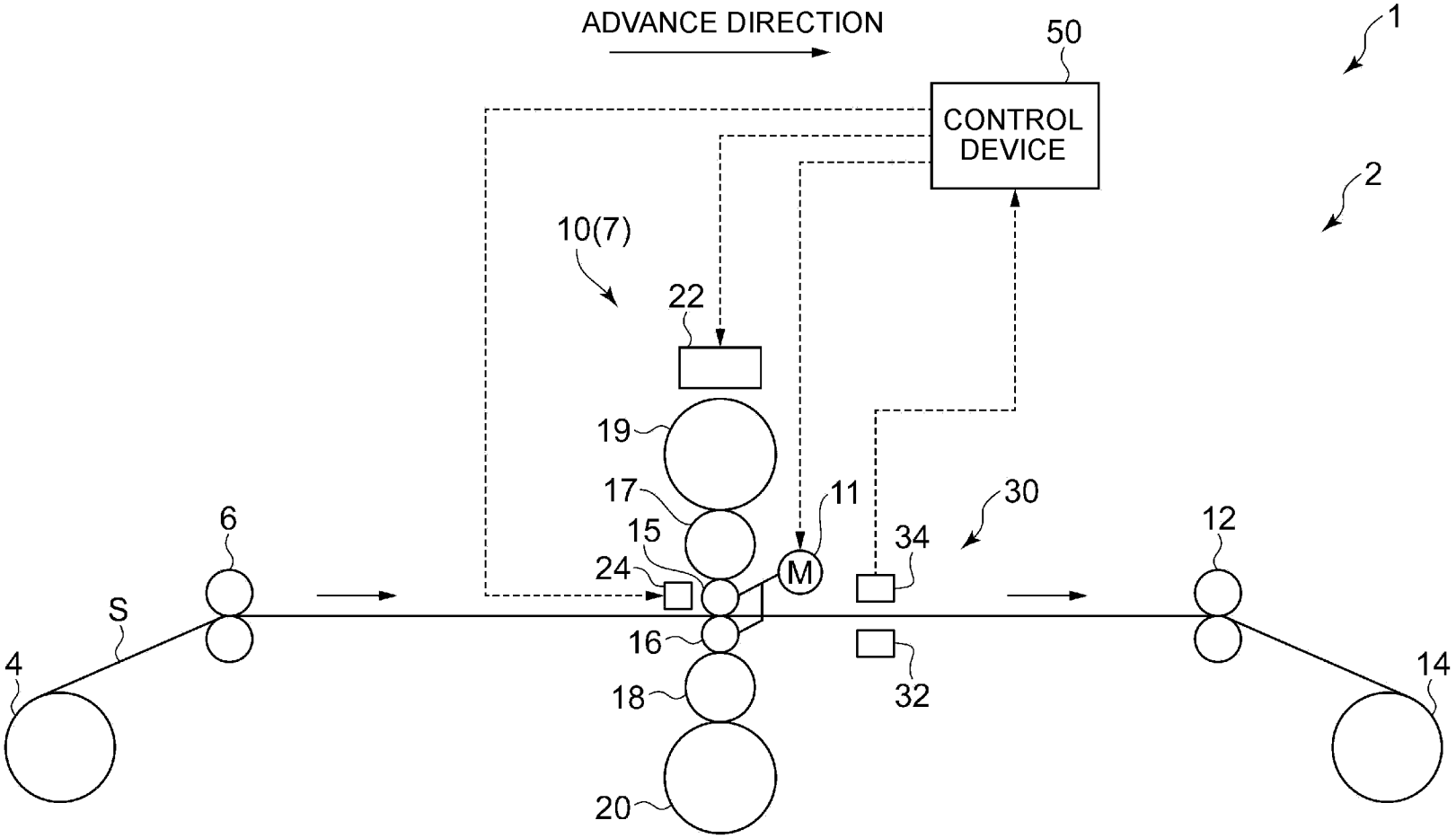
FIG. 1 is a schematic configuration diagram of a rolling mill facility including a control device according to an embodiment.
Figure 2:
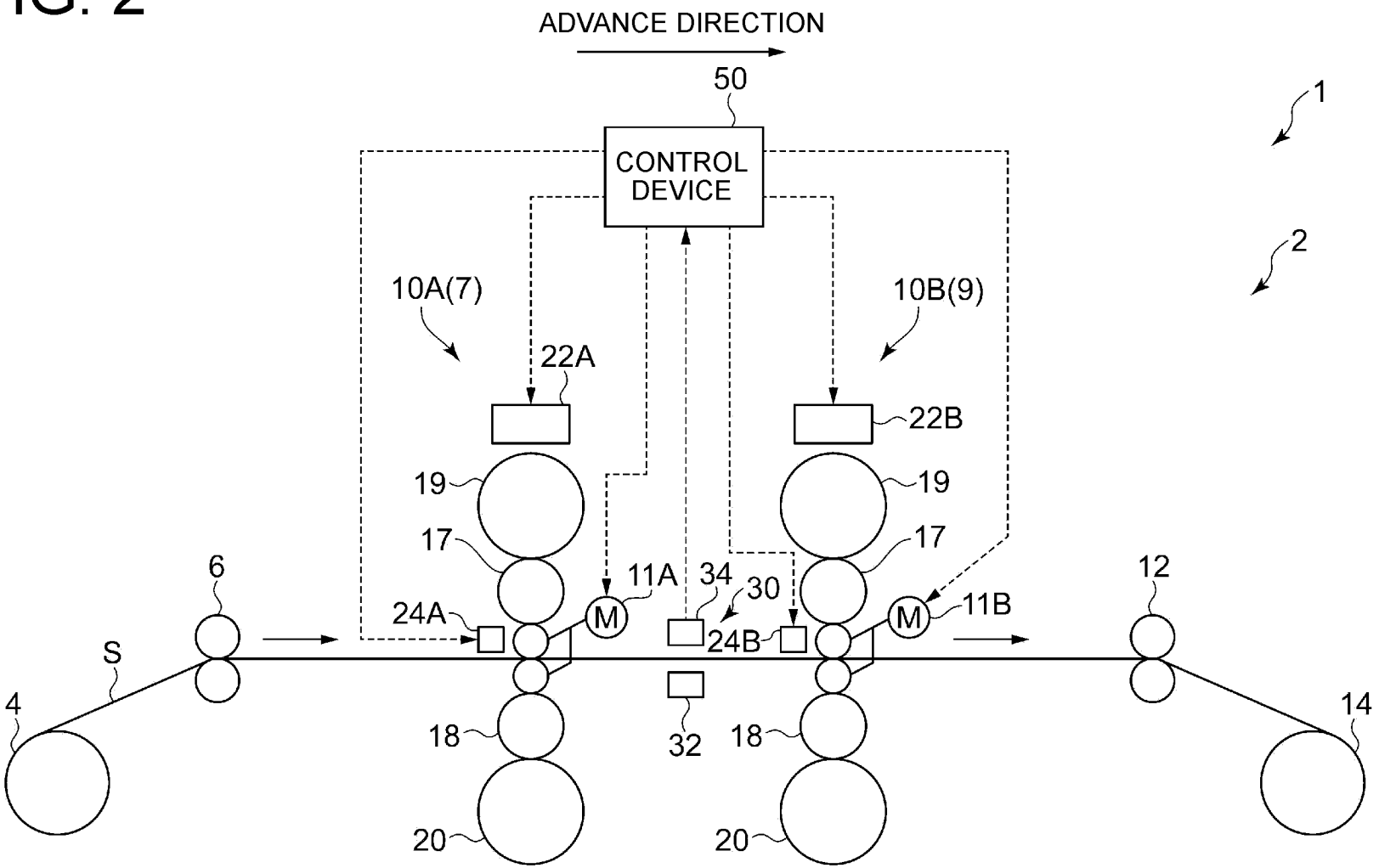
FIG. 2 is a schematic configuration diagram of a rolling mill facility including a control device according to an embodiment.
Figure 3:
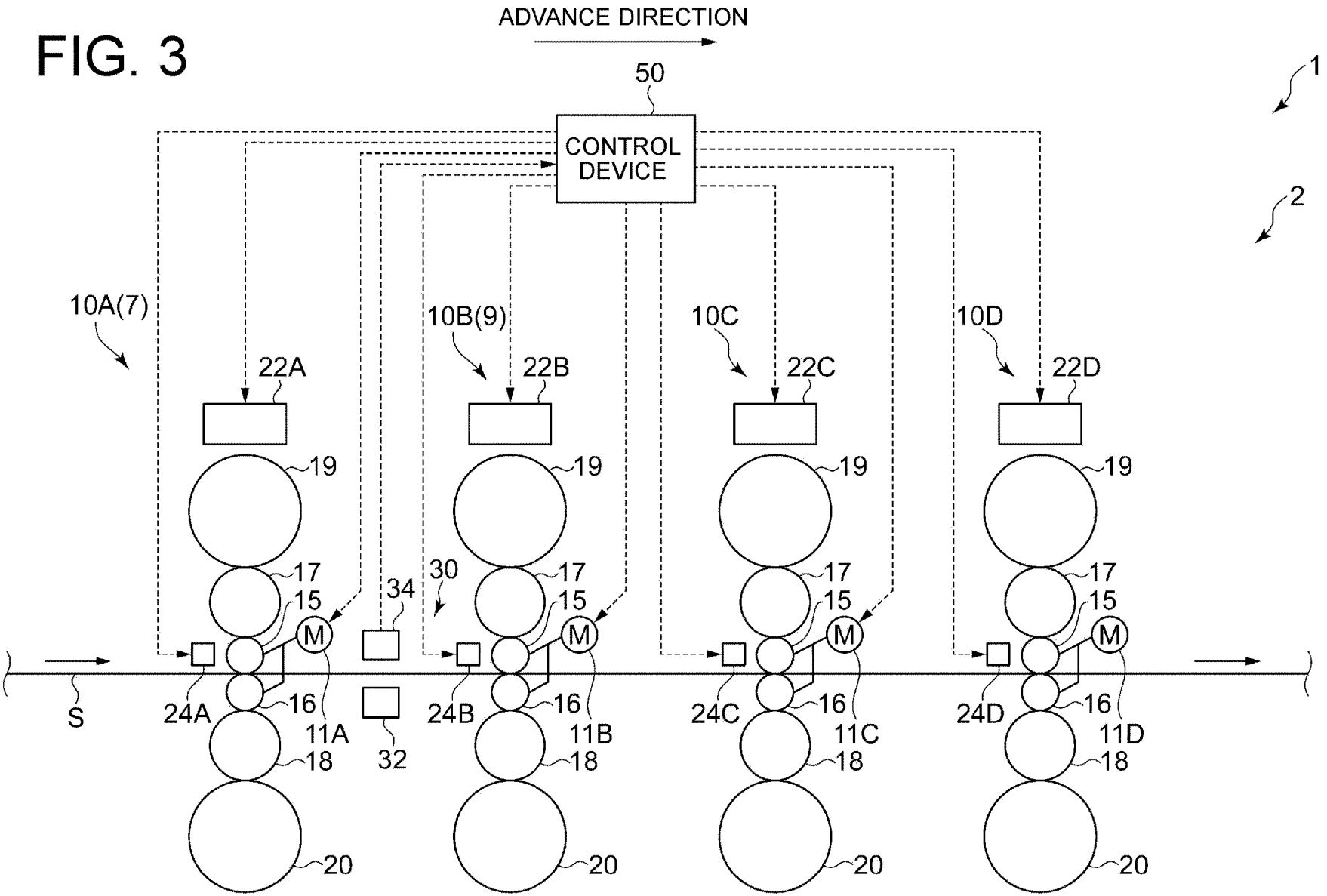
FIG. 3 is a schematic configuration diagram of a rolling mill facility including a control device according to an embodiment.

Firstly, the overall configuration of a rolling mill facility including a control device according to some embodiments will be described. FIGS. 1 to 3 are each a schematic configuration diagram of a rolling mill facility including a control device according to an embodiment. As depicted in FIGS. 1 to 3, a rolling mill facility 1 includes a rolling mill apparatus 2 configured to roll a metal plate S, an edge crack sensor 30 for detecting an edge crack of the metal plate S, and a control device 50 for controlling the rolling mill apparatus 2 on the basis of detection signals from the edge crack sensor 30.

The rolling mill apparatus 2 includes at least one rolling mill stand 10 for rolling the metal plate S. The rolling mill apparatus 2 may include a single rolling mill stand 10 as depicted in FIG. 1, for instance, or may include a plurality of rolling mill stands 10 as depicted in FIG. 2 or 3. In the illustrative embodiment depicted in FIG. 2, the rolling mill apparatus 2 includes two rolling mill stands including rolling mill stands 10A and 10B. In the illustrative embodiment depicted in FIG. 3, the rolling mill apparatus 2 includes four rolling mill stands 10 including the rolling mill stands 10A to 10D.

Each rolling stand 10 includes a pair of work rolls 15, 16 disposed so as to pinch the metal plate S being a rolling material, and a pair of intermediate rolls 17, 18 and a pair of backup rolls 19, 20 disposed opposite to the metal plate S across the pair of work rolls 15, 16, respectively. The intermediate rolls 17, 18 and the backup rolls 19, 20 are configured to support the work rolls 15, 16. Furthermore, the rolling mill stand 10 includes a rolling reduction device 22 (22A to 22D) for rolling the metal plate S by applying a load to the pair of work rolls 15, 16. The rolling down device 22 may include a hydraulic cylinder.

A motor 11 (11A to 11D) is connected to the work rolls 15, 16 via a spindle (not depicted) or the like, such that the work rolls 15, 16 are rotary driven by the motor 11. When the metal plate S is rolled, the motor rotates the work rolls 15, 16 while the rolling reduction device 22 rolls down the metal plate S, and thereby a friction force is generated between the work rolls 15, 16 and the metal plate S, whereby the metal plate S is sent to the output side of the work rolls 15, 16 by the friction force.

The rolling mill apparatus 2 includes an unwinder 4 for unwinding a coil of the metal plate S toward the rolling mill stand 10, and a rewinder 14 for rewinding the metal plate S from the rolling mill stand 10. The unwinder 4 and the rewinder 14 are each driven by a motor (not depicted). An input-side pinch roll 6 for guiding the metal plate S introduced into the rolling mill stand 10 from the unwinder 4 may be disposed between the rolling mill stand 10 and the unwinder 4. An output-side pinch roll 12 for guiding the metal plate S heading toward the rewinder from the rolling mill stand 10 may be disposed between the rolling mill stand 10 and the rewinder. In FIG. 3, the unwinder 4, the rewinder 14, the input-side pinch roll 6 and the output-side pinch roll 12 are omitted from the illustration.

The rolling mill apparatus 2 may be a rolling mill apparatus which rolls the metal plate S inserted between the pair of work rolls 15, 16 by causing the metal plate S to reciprocate. That is, the rolling mill apparatus 2 as a reverse mill is configured to roll the metal plate S in a plurality of passes. In a case where a reverse mill is used, in the rolling of an odd number time (e.g., 1st pass), the metal plate S is unwound from the unwinder 4 and rewound by the rewinder 14 to be rolled. Then, the rolling is stopped immediately before the tail end of the metal plate S unwound from the unwinder 4, and the rolling of an odd number time (e.g., 1st pass) is completed in a state where the metal plate S is pressed down by the work rolls 15, 16. Next, the metal plate S is unwound from the rewinder 14 toward the rolling mill stand 10, and the unwinder 4 rewinds the metal plate S while the metal plate S advances in an advance direction opposite to the previous direction, and thereby rolling of an even number time (e.g., 2nd pass) is performed. That is, the role of the unwinder 4 and the role of the rewinder 14 switch with one another in accordance with the advance direction of the metal plate S. The rolling mill apparatus 2 depicted in FIGS. 1 and 2 is a reverse mill.

Alternatively, the rolling mill apparatus 2 may be configured to perform rolling while causing the metal plate S inserted between the pair of work rolls 15, 16 to advance in a single direction. The rolling mill apparatus depicted in FIG. 3 is a tandem-type rolling mill apparatus configured to perform rolling while causing the metal plate S to advance in a single direction.

The edge crack sensor 30 is configured to detect an edge crack at an end portion of the metal plate S in the plate width direction (direction substantially orthogonal to the advance direction) (hereinafter, merely referred to as an end portion). The detection signal (signal indicating presence or absence of an edge crack) detected by the edge crack sensor 30 is sent to the control device 50.

Figure 4:
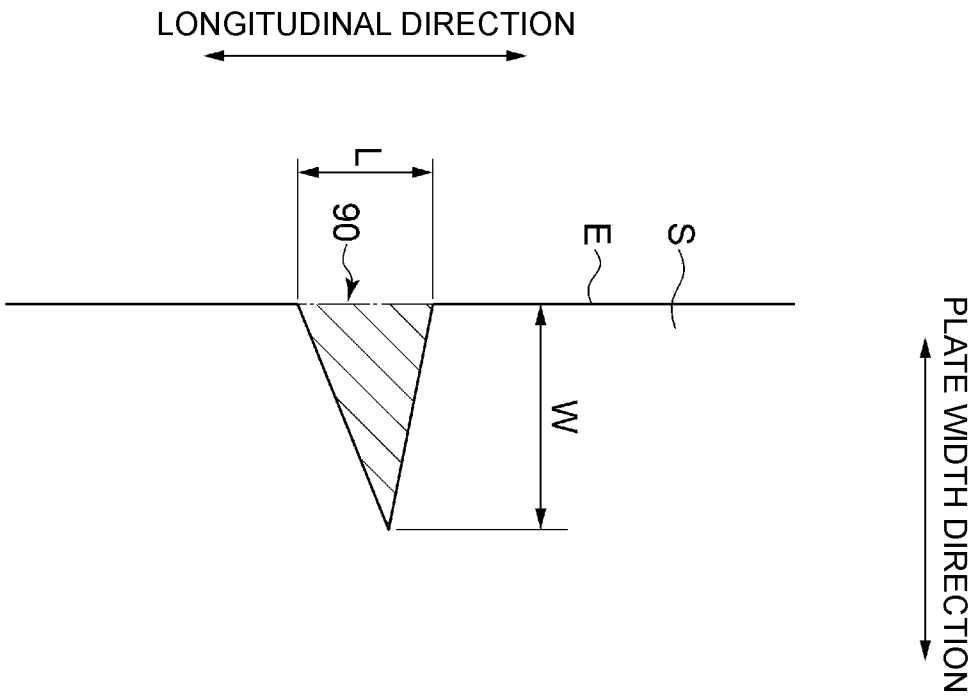
FIG. 4 is a schematic diagram of an edge crack formed on a metal plate.

Herein, FIG. 4 is a schematic diagram of an edge crack (shaded area in FIG. 4) formed on the metal plate S. As depicted in FIG. 4, an edge crack 90 is a defect that forms on an end portion of the metal plate S in the plate width direction. The edge crack 90 normally has a shape recessed inward in the plate width direction from the plate edge E of the metal plate S.

In some embodiments, the edge crack sensor 30 is disposed at the downstream side of one of the rolling mill stands 10 in the advance direction of the metal plate S. In the illustrative embodiment depicted in FIGS. 1 to 3, the edge crack sensor 30 is disposed at the downstream side of the rolling mill stand 10 positioned most upstream (rolling mill stand 10A in FIGS. 2 and 3), of the rolling mill stands 10 (10A to 10D) included in the rolling mill apparatus 2. Herein, the rolling mill stand 10 positioned at the upstream side of the edge crack sensor 30 (the rolling mill stand 10 in FIG. 1, the rolling mill stand 10A in FIGS. 2 and 3) is an upstream side stand 7.

In some embodiments, the edge crack sensor 30 is disposed between a pair of rolling mill stands 10 in the advance direction of the metal plate S. For instance, in the illustrative embodiment depicted in FIGS. 2 and 3, in the advance direction of the metal plate S, the edge crack sensor 30 is disposed between the most upstream rolling mill stand 10A and the next rolling mill stand 10B. Herein, the rolling mill stand 10 positioned at the downstream side of the edge crack sensor 30 (rolling mill stand 10B in FIGS. 2 and 3) is a downstream side stand 9.

The position of the edge crack sensor 30 and the number of the edge crack sensor 30 are not limited to those illustrated in FIGS. 1 to 3. For instance, in some embodiments, the edge crack sensor 30 may be disposed at the upstream side of one of the rolling mill stands 10 in the advance direction of the metal plate S. Furthermore, in some embodiments, a plurality of edge crack sensors 30 may be provided for a rolling mill apparatus 2.

For instance, in the rolling mill apparatus 2 depicted in FIG. 1, in addition to the edge crack sensor 30 depicted in the drawing, another edge crack sensor 30 may be disposed at the upstream side of the rolling mill stand 10. Furthermore, in the rolling mill apparatus 2 depicted in FIG. 2, in addition to the edge crack sensor 30 depicted in the drawing, another edge crack sensor 30 may be disposed at the upstream side of the rolling mill stand 10A and/or the downstream side of the rolling mill stand 10B. Furthermore, in the rolling mill apparatus 2 depicted in FIG. 3, an edge crack sensor 30 may be disposed between the rolling mill stand 10B and the rolling mill stand 10C, and/or between the rolling mill stand 10C and the rolling mill stand 10D.

In some embodiments, the edge crack sensor 30 is configured to detect the edge crack using radiation (e.g., X-rays). In the illustrative embodiment depicted in FIGS. 1 to 3, the edge crack sensor 30 includes a radiation generation part 32 configured to generate radiation toward an end portion of the metal plate S in the plate width direction, and a radiation detection part 34 disposed at the opposite side to the radiation generation part 32 across the metal plate S and configured to receive radiation from the radiation generation part 32. The edge crack sensor 30 is configured to detect an edge crack on the basis of the range in the plate width direction in which the radiation detection part 34 receives radiation.

In an embodiment, the radiation detection part 34 includes semiconductor elements that output signals upon receiving radiation. In this case, since a semiconductor element can be reduced in size easily, it is possible to reduce the size of the edge crack sensor 30 compared to a radiation detector including a gas chamber as a constituent element, for instance, and it is possible to detect even a relatively small edge crack.

The above described semiconductor elements may be cadmium telluride (CdTe) semiconductor elements. CdTe semiconductors have a high resolution, and thus likely to appropriately detect even a relatively small edge crack.

Figure 5:
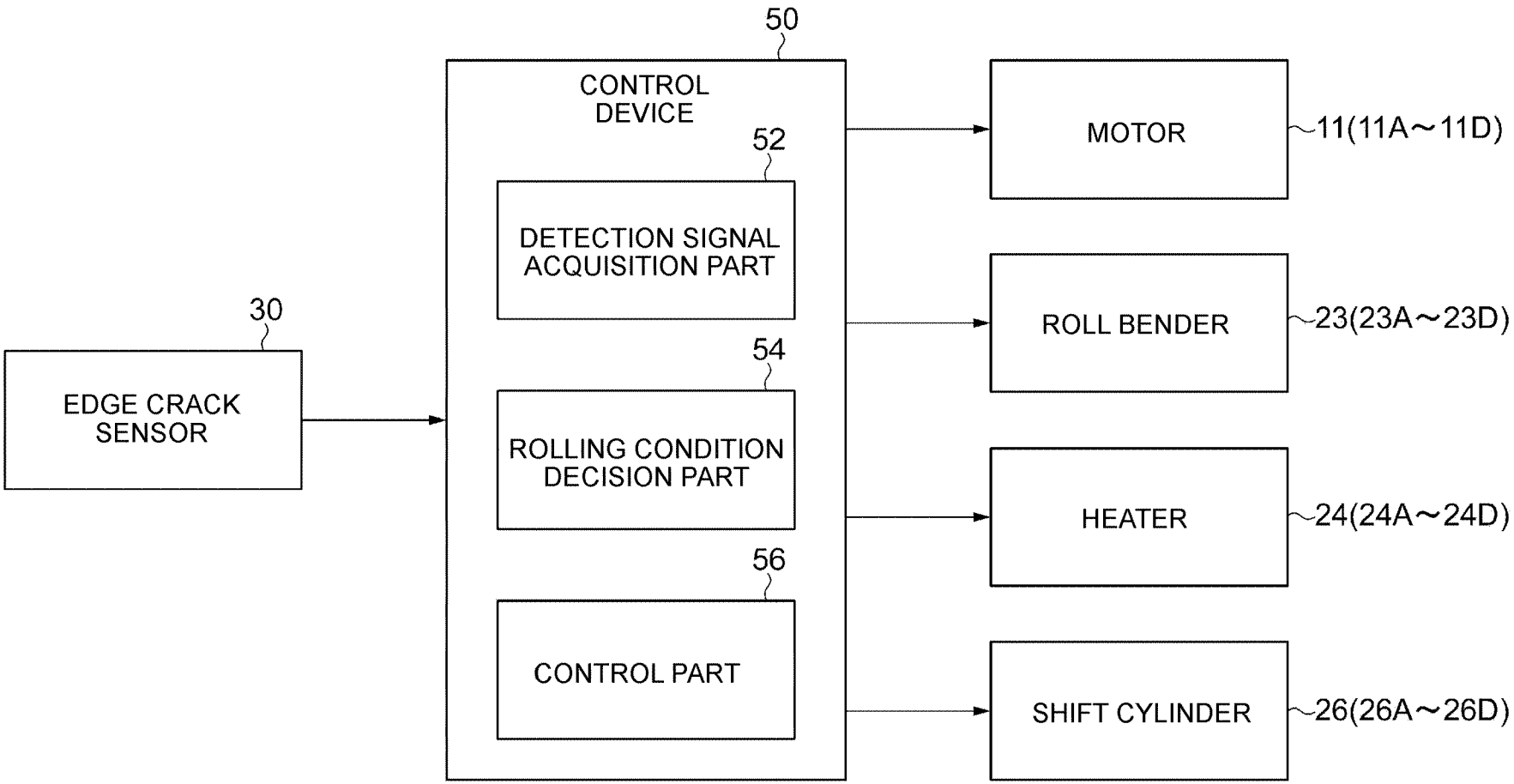
FIG. 5 is a schematic configuration diagram of a control device according to an embodiment.

FIG. 5 is a schematic configuration diagram of a control device 50 according to an embodiment. The control device 50 is configured to receive detection signals from the edge crack sensor 30 and control operation of the rolling mill apparatus 2 on the basis of the detection signals. As depicted in FIG. 5, the control device 50 includes a detection signal acquisition part 52, a rolling condition decision part 54, and a control part 56.

The control device 50 includes a calculator including a processor (CPU), a storage device (memory device; RAM and the like), an auxiliary storage part, and an interface, for instance. The control device 50 is configured to receive detection signals from the edge crack sensor 30 via an interface. The processor is configured to process the accordingly received signals. Furthermore, the processor is configured to process the program expanded in the storage device. Accordingly, the function of each of the above described functional parts (the rolling condition decision part 54 and the like) is realized.

The content of process at the control device 50 is implemented as a program to be executed by the processor. The program may be stored in the auxiliary storage part. When the program is executed, the program is expanded in the storage part. The processor is configured to read out the program from the storage device, and executes the commands contained in the programs.

The detection signal acquisition part 52 is configured to receive detection signals (signals indicating presence of absence of an edge crack) from the edge crack sensor 30.

The rolling condition decision part 54 is configured to decide the rolling condition for the rolling mill apparatus 2 on the basis of the detection signals received by the detection signal acquisition part 52. Herein, the rolling condition may include the advance speed of the metal plate S or the tension of the metal plates S.

The control part 56 is configured to control operation of the rolling mill apparatus 2 such that the rolling condition decided by the rolling condition decision part 54 is realized. The control part 56 may be configured to control operation of a motor 11 (11A to 11D), a roll bender 23 (23A to 23D) (not depicted in FIGS. 1 to 3), a heater 24 (24A to 24D) or a shift cylinder 26 (26A to 26D) (not depicted in FIGS. 1 to 3) provided corresponding to the rolling mill stand 10 (10A to 10D) such that the above described rolling condition is realized.

The roll bender 23 is configured to bend the work rolls 15, 16 by pressing an end portion, in the axial direction, of the work rolls 15, 16 in the up-down direction. By deforming the work rolls 15, 16 as described above and compressing the end portion of the metal plate S being rolled, the material expands, and the tension at the end portion of the metal plate S decreases. The roll bender 23 may include a hydraulic cylinder capable of pushing the end portion of the work rolls 15, 16 in the up-down direction.

The heater 24 is configured to heat an end portion of the metal plate S being rolled. By heating the end portion of the metal plate S as described above, the temperature of the end portion of the metal plate S increases and the material expands, and thereby the tension of the end portion of the metal plate S decreases. The heater 24 may be disposed in the vicinity of the end portion of the metal plate S and configured to heat the end portion of the metal plate S being rolled. Alternatively, the heater 24 may be disposed in the vicinity of the end portion of the work rolls 15, 16 and configured to heat the end portion of the work rolls 15, 16 so as to indirectly heat the end portion of the metal plate S being rolled by the work rolls 15, 16. The heater 24 may be configured to heat the end portion of the metal plate S by using an electromagnetically induced coil, a heat medium, or a laser beam.

A shift cylinder 26 is configured to shift the work rolls 15, 16 in the axial direction. In this case, the work rolls 15, 16 have a tapered portion which becomes thinner toward the tip in the axial direction at the end portion in the axial direction. By shifting the work rolls 15, 16 having such a tapered portion outward in the axial direction, it is possible to mitigate the tension at the end portion of the metal plate S. The shift cylinder 26 may include a hydraulic cylinder capable of moving the work rolls 15, 16 in the axial direction.

(Flow of Operation Method of Rolling Mill Apparatus)

Next, the operation method for the rolling mill apparatus according to some embodiments will be described. While the following description describes a case in which the above described control device 50 is used to control operation of a rolling mill apparatus according to an embodiment, another device may be used to operate a rolling mill apparatus in some other embodiments. Alternatively, in some embodiments, a part of or the entire operation method described below may be carried out by an operator.

Figure 6:
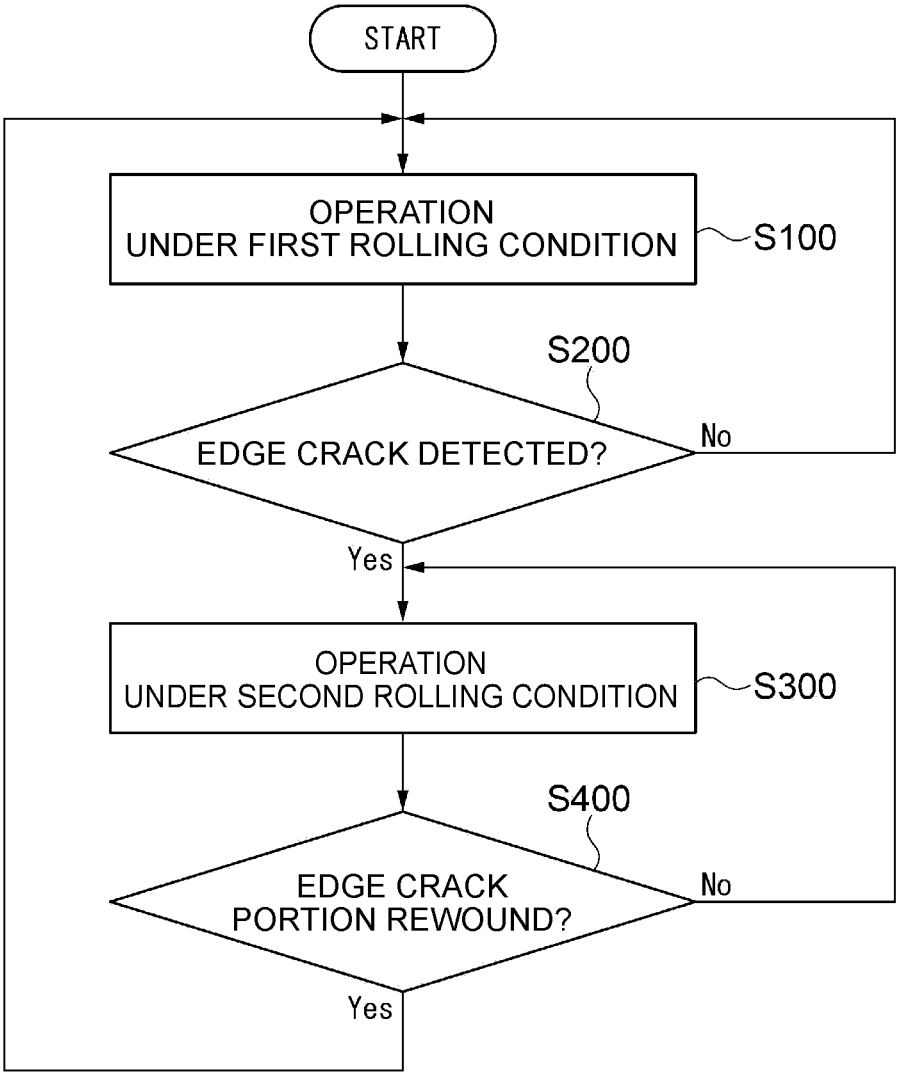
FIG. 6 is a flowchart of an operation method for a rolling mill apparatus according to an embodiment.

FIG. 6 is a flowchart of an operation method for a rolling mill apparatus according to an embodiment. In the embodiment according to the flowchart of FIG. 6, the rolling mill apparatus 2 is operated under the first rolling condition to roll the metal plate S (S100). During operation under the first rolling condition, the speed of the metal plate S in the advance direction (advance speed) and the tension at the end portion of the metal plate S are each within a predetermined range. That is, in step S100, the rolling condition decision part 54 sets the rolling condition for the rolling mill apparatus 2 to the first rolling condition, and the control part 56 controls operation of the motor 11 or the like of the rolling mill apparatus 2 so as to realize operation under the first rolling condition (the speed and the tension at the end portion of the metal plate S).

Next, an edge crack of the metal plate S is detected using the edge crack sensor 30 (S200). In step S200, as depicted in FIGS. 1 to 3, an edge crack may be detected by using the edge crack sensor 30 disposed at the downstream side of one of the rolling mill stands 10 (the rolling mill stand 10 in FIG. 1, the rolling mill stand 10A in FIGS. 2 and 3; i.e., the upstream side stand 7). In this case, an edge crack having grown to some extent after passing through the upstream side stand 7 is detected, and thus it is possible to detect an edge crack more reliably.

While the edge crack sensor 30 does not detect an edge crack (No in S200), operation under the first rolling condition (S100) is continued. If an edge crack is detected in step S200 (that is, if the detection signal acquisition part 52 receives a detection signal; Yes in S200), the operation condition for the rolling mill apparatus 2 is changed from the first rolling condition to the second rolling condition that is capable of suppressing growth of an edge crack (S300).

That is, in step S300, the rolling condition decision part 54 sets the rolling condition for the rolling mill apparatus 2 to the second rolling condition. Then, the control part 56 controls operation of the rolling mill apparatus 2 so as to realize operation under the second rolling condition (the speed and the tension at the end portion of the metal plate S). Accordingly, by changing the rolling condition for the rolling mill apparatus 2 to a rolling condition that is capable of suppressing growth of an edge crack (second rolling condition) in response to detection of an edge crack at an end portion of the metal plate S in the plate width direction, it is possible to suppress growth of an edge crack during rolling or plate breakage due to growth of an edge crack.

In an embodiment, during operation of the rolling mill apparatus 2 under the second rolling condition in step S300, the rolling mill apparatus 2 is controlled such that the tension at the end portion of the metal plate S is smaller than the tension at the end portion of the metal plate S under the first rolling condition (the tension in step S100). Specifically, the control part 56 operates the roll bender 23, the heater 24, or the shift cylinder 26 provided corresponding to the rolling mill stand 10 so as to obtain a desired tension. Accordingly, in step S300, the tension at the end portion of the metal plate S in the plate width direction is reduced to be slower than that in operation under the first rolling condition, and thereby it is possible to suppress growth of an edge crack during rolling effectively.

Alternatively, in an embodiment, during operation of the rolling mill apparatus 2 under the second rolling condition in step S300, the rolling mill apparatus 2 is controlled such that the advance speed of the metal plate S is smaller than the advance speed of the metal plate S under the first rolling condition (the advance speed in step S100). Specifically, the control part 56 controls the motor 11 of the rolling mill stand 10 so as to obtain a desired advance speed. Accordingly, in step S300, the advance speed of the metal plate S is reduced to be slower than that in operation under the first rolling condition, and thereby it is possible to reduce damage to surrounding devices even if plate breakage occurs due to an edge crack during rolling.

Next, it is determined whether an edge crack portion is rewound by the rewinder 14 (S400). Herein, an edge crack portion being rewound by the rewinder 14 means that the edge crack portion is rewound by the rewinder for one round.

In step S400, the position of the edge crack portion is obtained by calculation, and it may be determined whether the edge crack portion is rewound by the rewinder 14 on the basis of the calculation result. The position of the edge crack portion may be calculated, for instance, on the basis of the length of time from the point of time when the detection signal acquisition part 52 receives a detection signal from the edge crack sensor 30 (detection signal indicating the existence of an edge crack), the speed of the metal plate S, the distance between the edge crack sensor 30 and the rewinder 14, the mandrel diameter of the rewinder 14, or the like. Alternatively, in step S400, it may be determined whether the edge crack portion is rewound by the rewinder 14 by capturing an image of the metal plate S being rewound by the rewinder 14 using an image capturing device such as a camera disposed in the vicinity of the rewinder 14.

In step S400, while it is not determined that the edge crack portion is rewound by the rewinder (No in S400), operation under the second rolling condition (S300) is continued. If it is determined that the edge crack portion is rewound by the rewinder in step S400 (Yes in S400), the operation condition for the rolling mill apparatus 2 is set back from the second rolling condition to the first rolling condition to operate the rolling mill apparatus 2 (S100).

As described above, after an edge crack is detected, operation under the second rolling condition is maintained until the edge crack portion of the metal plate S is rewound by the rewinder 14, and thereby it is possible to suppress growth of the detected edge crack during rolling effectively.

Furthermore, by setting back the rolling condition from the second rolling condition to the first rolling condition once the edge crack portion is wound by the rewinder as described above, it is possible to suppress growth of an edge crack during rolling while suppressing deterioration of the production efficiency.

In some embodiments, in a case where the rolling mill apparatus 2 includes a plurality of rolling mill stands 10, in step S200 (see FIG. 6), an edge crack is detected by using the edge crack sensor 30 positioned at the downstream side of the upstream side stand 7 (the rolling mill stand 10A in FIGS. 2 and 3). If the edge crack sensor 30 detects an edge crack (Yes in S200), as described above, the operation condition for the rolling mill apparatus 2 is changed from the first rolling condition to the second rolling condition that is capable of suppressing growth of an edge crack (S300). During operation under the second rolling condition in step S300, the tension at the end portion of the metal plate S in the region between the upstream side stand 7 and the downstream side stand 9 is reduced to be smaller than the tension under the first rolling condition until the edge crack passes through the downstream side stand 9 (the rolling mill stand 10B in FIGS. 2 and 3). Once the edge crack passes through the downstream side stand 9, the tension at the end portion of the metal plate S in the region between the upstream side stand 7 and the downstream side stand 9 is changed back to the tension under the first rolling condition (tension in step S100).

In the above described embodiment, if an edge crack is detected, the tension at the end portion in the region between the upstream side stand 7 and the downstream side stand 9 is reduced to be smaller than the tension under the first rolling condition until the edge crack passes through the downstream side stand 9, and thus it is possible to suppress growth of the edge crack during rolling. Furthermore, once the edge crack portion passes through the downstream side stand 9, the tension at the end portion in the region between the upstream side stand 7 and the downstream side stand 9 is changed back to the tension under the first rolling condition, and thus it is possible to suppress growth of an edge crack during rolling while suppressing deterioration of production efficiency.

Figure 7:
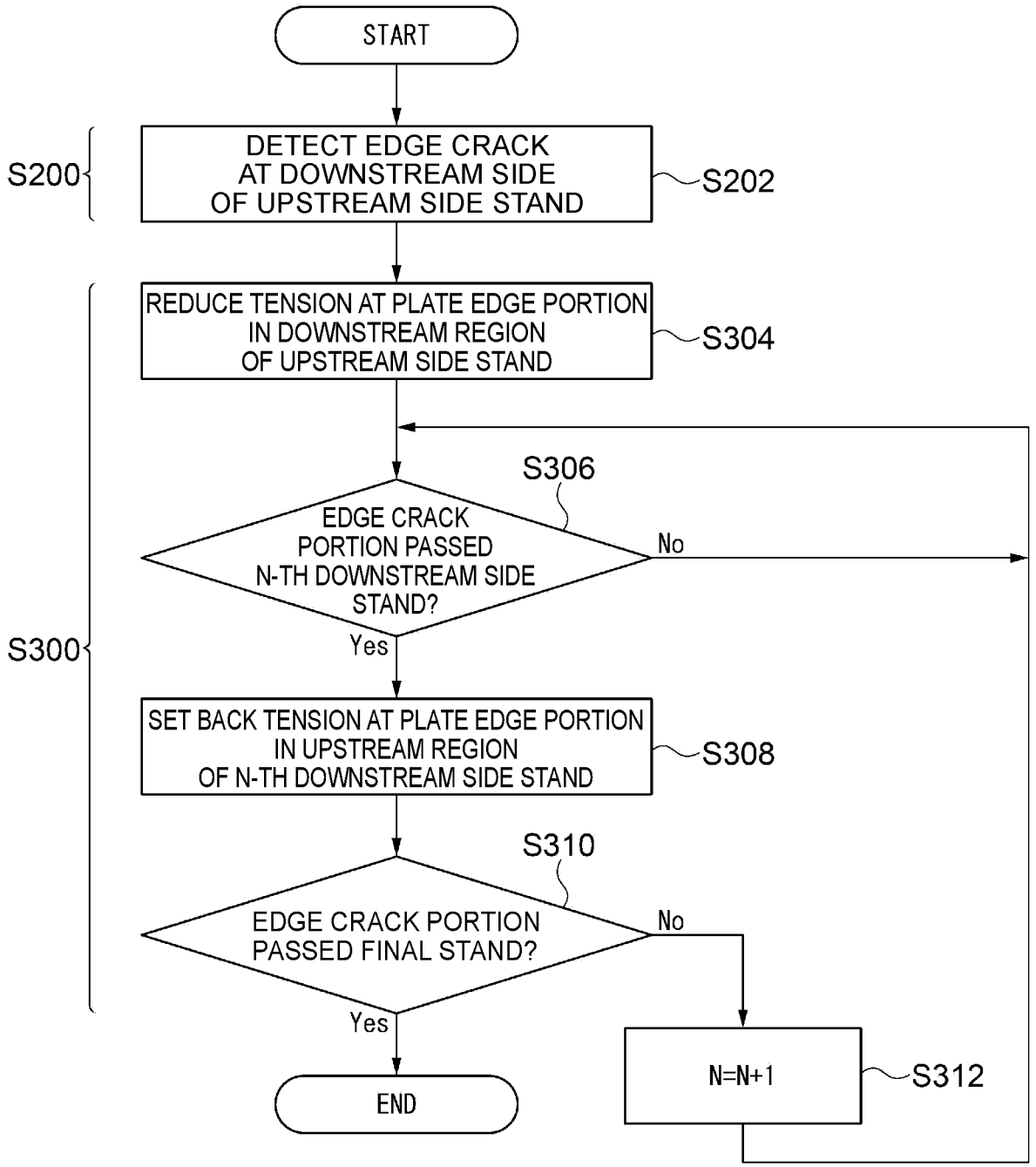
FIG. 7 is an example of the flow of step S200 to step S300 illustrated in FIG. 7.

FIG. 7 is an example of the flow of the above described steps S200 to S300 regarding the rolling mill apparatus 2 (see FIG. 2 or 3) including the plurality of rolling mill stands 10. In the embodiment depicted in FIG. 7, step 300 is carried out in the following order if an edge crack is detected by the edge crack sensor 30 positioned at the downstream side of the upstream side stand 7 (rolling mill stand 10A in FIGS. 2 and 3) in step S200 (S202).

Firstly, the tension of the end portion of the metal plate S in a region at the downstream side of the upstream side stand 7 (the rolling mill stand 10A in FIGS. 2 and 3) is reduced (S304). Specifically, the control part 56 operates the roll bender 23, the heater 24, or the shift cylinder 26 disposed corresponding to the upstream side stand 7 (the rolling mill stand 10A) and the respective rolling mill stands 10 (10B to 10D) positioned downstream thereof so as to obtain a smaller tension than the tension under the first rolling condition, in each region between a pair of adjacent rolling mill stands 10 (e.g., the region between the rolling mill stands 10A and 10B, or the region between the rolling mill stands 10B and 10C).

Next, if the edge crack portion passes through the rolling mill stand 10 immediately downstream the edge crack sensor 30 (the rolling mill stand 10B in FIGS. 2 and 3) (Yes in S306), the tension at the end portion of the metal plate S in the region between the rolling mill stand 10 (the rolling mill stand 10B) and the rolling mill stand upstream thereof (the rolling mill stand 10A) is changed back to the same tension as that under the first rolling condition (S308). As decried above, the operation to change back the tension of the end portion of the metal plate S in the region between the rolling mill stand 10 that the edge crack portion has passed by and the rolling mill stand 10 upstream thereof is repeated until the edge crack portion passes through the most downstream rolling mill stand 10 (the final stand; the rolling mill stand 10B in FIG. 2, the rolling mill stand 10D in FIG. 3) (No in S310, S312). When the edge crack portion passes through the final stand (Yes in S310), step S300 is completed, and the flow advances to step S400 (see FIG. 6).

In the above described embodiment, until the detected edge crack portion passes through a downstream rolling mill stand 10, the tension at the end portion of the metal plate S in the region between the rolling mill stand 10 and the adjacent rolling mill stand 10 upstream thereof is reduced to be smaller than the tension under the first rolling condition, and thus it is possible to suppress growth of an edge crack during rolling. Furthermore, once the edge crack portion passes through the downstream rolling mill stand 10, the tension at the end portion of the metal plate S in the region between the rolling mill stand 10 and the adjacent rolling mill stand 10 upstream thereof is set back to the tension under the first rolling condition, and thus it is possible to suppress growth of an edge crack during rolling while suppressing deterioration of production efficiency.

In a case where the rolling mill apparatus 2 is a reverse mill configured to roll the metal plate S along a plurality of passes (see FIGS. 1 and 2), the rolling condition decision part 54 may decide the rolling condition for the next and subsequent passes for metal plate S by the rolling mill apparatus 2 on the basis of the detection results received from the edge crack sensor 30 during rolling of the rolling mill apparatus 2.

In this case, by deciding the rolling condition for the next and subsequent passes on the basis of the detection results of the edge crack sensor 30 during rolling, it is possible to suppress growth of an edge crack and plate breakage during rolling of the next and subsequent passes.

In an embodiment, the rolling condition decision part 54 is configured to decide whether to perform rolling of the next pass of the metal plate S by the rolling mill apparatus 2 on the basis of the size of the edge crack of the metal plate S detected by the edge crack sensor 30. Herein, the size of the edge crack may be the width W of the edge crack 90 in the plate width direction of the metal plate S (see FIG. 4), or the length L of the edge crack 90 in the longitudinal direction (advance direction) of the metal plate S (see FIG. 4).

In the above described embodiment, by deciding whether to perform rolling of the next pass on the basis of the size of the detected edge crack, it is possible to suppress growth of an edge crack and plate breakage during rolling of the next and subsequent passes effectively.

In an embodiment, the rolling condition decision part 54 is configured to decide the timing to change the rolling condition during rolling of the next pass of the metal plate S by the rolling mill apparatus 2 on the basis of the position, in the longitudinal direction of the metal plate S, of the edge crack detected by the edge crack sensor 30.

In the above described embodiment, by deciding the timing to change the rolling condition during rolling of the next pass on the basis of the position of the detected edge crack in the longitudinal of the metal plate, it is possible to suppress growth of an edge crack during rolling while suppressing deterioration of the production efficiency.

Figure 8:
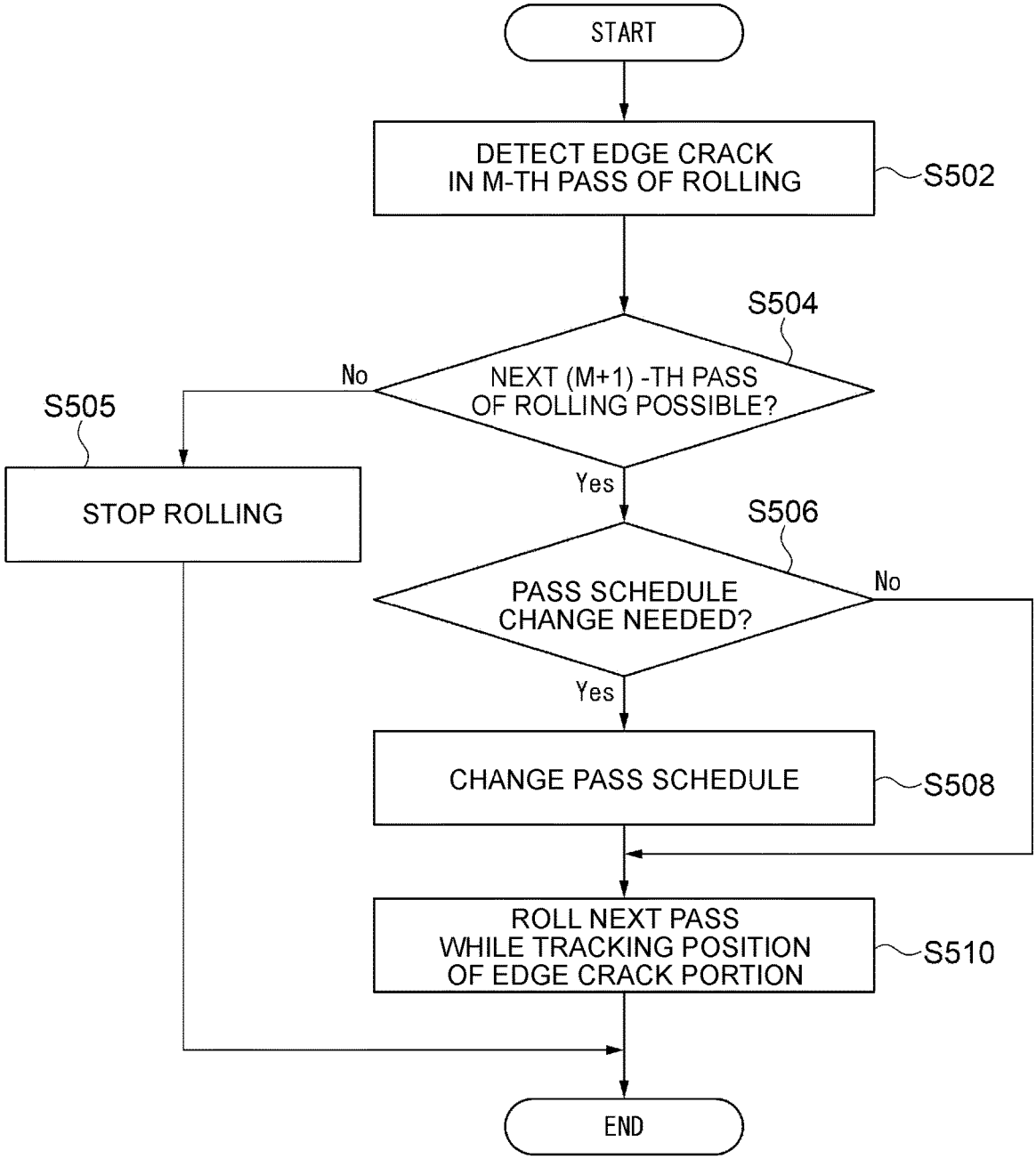
FIG. 8 is a flowchart of an operation method for a rolling mill apparatus according to an embodiment.

FIG. 8 is a flowchart of an operation method for a rolling mill apparatus 2 according to an embodiment. The flowchart in FIG. 8 is for a reverse mill (see FIGS. 1 and 2). In the present embodiment, if the edge crack sensor 30 detects an edge crack during rolling of a M-th pass (S502), the rolling condition decision part 54 decides whether it is possible to carry out rolling of the next (M+1) pass on the basis of the size of the detected edge crack.

In step S504, if the size of the edge crack is larger than a predetermined value, it is determined that the rolling of the next pass is not viable (No in S504), and rolling of the metal plate S is stopped (S505). Conversely, in step S504, if the size of the edge crack is not larger than predetermined value, it is determined that the rolling of the next pass is viable (Yes in S504).

Next, the rolling condition decision part 54 decides whether it is necessary to change the pass schedule (i.e., change the target plate thickness) for the rolling of the next (M+1)-th pass (S506). In step S506, the above determination may be performed on the basis of the size of the edge crack detected in step S502. For instance, it may be determined that it is necessary to set the target thickness to be larger than the originally set thickness if the size of the edge crack is larger than a predetermined value. Alternatively, in step S506, the necessity to change the pass schedule may be determined on the basis of the stress applied to the edge crack or the shape of the edge crack. If it is determined that it is necessary to change the pass schedule in step S506 (Yes in S506), the pass schedule is changed (that is, the target thickness of the rolling mill apparatus 2 is changed; step S508).

Next, the rolling mill apparatus 2 rolls the metal plate S along the next (M+1)-th pass while tracking the position of the edge crack portion (S510). In step S510, for instance, the position of the edge crack in the longitudinal direction of the metal plate S is calculated on the basis of the detection result of the edge crack sensor 30 in step S502. The rolling condition may be changed before or after the point of the time when the edge crack portion starts from the unwinder 4 on the basis of the position of the edge crack calculated accordingly. For instance, the tension of the end portion of the metal plate S may be reduced, or the advance speed of the metal plate S may be reduced in the period from the second point of time when the edge crack portion starts from the unwinder 4 to the third point of time when the edge crack portion is rewound by the rewinder, compared to the period from the first point of time when rolling of the (M+1)-th pass is started to the second point of time.

As described above, in a case where the rolling mill apparatus 2 is a reverse mill, by deciding the rolling condition for the next and subsequent passes on the basis of the detection results of the edge crack sensor 30 during rolling, it is possible to suppress growth of an edge crack and plate breakage during rolling of the next and subsequent passes effectively.

Hereinafter, a control device for a rolling mill apparatus, a rolling mill facility, and an operation method for a rolling mill apparatus will be described in summary.

(1) According to at least one embodiment of the present invention, a control device for a rolling mill apparatus including at least one rolling mill stand for rolling a metal plate includes: a detection signal acquisition part for receiving, from an edge crack sensor, a detection signal of an edge crack at an end portion of the metal plate in a plate width direction; and a rolling condition decision part for deciding a rolling condition for the rolling mill apparatus. The rolling condition decision part is configured to change, if the detection signal acquisition part receives the detection signal of the edge crack, the rolling condition for the rolling mill apparatus from a first rolling condition immediately before detection of the edge crack to a second rolling condition which is more capable of suppressing growth of the edge crack than the first rolling condition.

With the above configuration (1), the rolling condition for the rolling mill apparatus is changed to a rolling condition that is capable of suppressing growth of an edge crack (the second rolling condition) in response to detection of an edge crack at an end portion of the metal plate in the plate width direction, and thus it is possible to suppress growth of an edge crack during rolling or plate breakage due to growth of an edge crack.

(2) In some embodiments, in the above configuration (1), the rolling condition decision part is configured to maintain the rolling condition for the rolling mill apparatus to the second rolling condition after the detection signal acquisition part receives the detection signal of the edge crack and at least until a portion of the metal plate which includes the edge crack portion is rewound by a rewinder of the rolling mill apparatus.

With the above configuration (2), operation under the second rolling condition is maintained after detection of an edge crack until a portion of the metal plate including the edge crack (hereinafter, referred to as an edge crack portion) is rewound by the rewinder. Thus, it is possible to effectively suppress growth of the detected edge crack during rolling.

(3) In some embodiments, in the above configuration (2), the rolling condition decision part is configured to set the rolling condition for the rolling mill apparatus back to the first rolling condition after the portion of the metal plate including the edge crack is rewound by the rewinder.

With the above configuration (3), the rolling condition is set back from the second rolling condition to the first rolling condition once the edge crack portion is rewound by the rewinder, and thus it is possible to suppress growth of an edge crack during rolling while suppressing deterioration of the production efficiency.

(4) In some embodiments, in any one of the above configurations (1) to (3), the rolling condition decision part is configured to reduce, during operation of the rolling mill apparatus under the second rolling condition, an advance speed of the metal plate to be smaller than the advance speed of the metal plate under the first rolling condition.

With the above configuration (4), during operation of the rolling mill apparatus under the second rolling condition, the advance speed of the metal plate is reduced to be smaller than that in operation under the first rolling condition, and thereby it is possible to reduce damage to surrounding devices even if plate breakage occurs due to an edge crack during rolling.

(5) In some embodiments, in any one of the above configurations (1) to (3), the rolling condition decision part is configured to reduce, during operation of the rolling mill apparatus under the second rolling condition, a tension at an end portion of the metal plate in the plate width direction to be smaller than the tension under the first rolling condition.

With the above configuration (5), during operation of the rolling mill apparatus under the second rolling condition, the tension at the end portion of the metal plate in the plate width direction is reduced to be smaller than that in operation under the first rolling condition, and thereby it is possible to suppress growth of an edge crack during rolling.

(6) In some embodiments, in any one of the above configurations (1) to (5), the at least one rolling mill stand includes an upstream-side stand disposed at an upstream side of a detection position of the edge crack in an advance direction of the metal plate.

In a case where the size of an edge crack formed on the metal plate is small, it may be difficult to detect the edge crack with a detector. In this regard, with the above configuration (6), an edge crack having grown to some extent after passing through the upstream side stand is detected, and thus it is possible to detect an edge crack more reliably.

(7) In some embodiments, in the above configuration (6), the at least one rolling mill stand includes a downstream-side stand disposed at a downstream side of the detection position of the edge crack in the advance direction, and the rolling condition decision part is configured to, during operation of the rolling mill apparatus under the second rolling condition: reduce a tension of an end portion of the metal plate in the plate width direction in a region between the upstream-side stand and the downstream-side stand to be smaller than the tension under the first rolling condition until the edge crack passes through the downstream side stand; and set the tension in the region back to the tension under the first rolling condition after the edge crack passes through the downstream-side stand.

With the above configuration (7), if an edge crack is detected, the tension at the end portion in the region between the upstream side stand and the downstream side stand is reduced to be smaller than the tension under the first rolling condition until the edge crack passes through the downstream side stand, and thus it is possible to suppress growth of an edge crack during rolling. Furthermore, once the edge crack passes through the downstream side stand, the tension at the end portion in the region between the upstream side stand and the downstream side stand is set back to the tension under the first rolling condition, and thus it is possible to suppress growth of an edge crack during rolling while suppressing deterioration of production efficiency.

(8) In some embodiments, in any one of the above configurations (1) to (7), the rolling mill apparatus is configured to roll the metal plate in a plurality of passes, and the rolling condition decision part is configured to decide the rolling condition for the next and subsequent passes of the metal plate by the rolling mill apparatus on the basis of the detection result received from the edge crack sensor during rolling by the rolling mill apparatus.

With the above configuration (8), a rolling mill apparatus configured to roll the metal plate for a plurality of passes is configured to decide the rolling condition for the next and subsequent passes on the basis of the detection results of the edge crack sensor during rolling, and thus it is possible to suppress growth of an edge crack and plate breakage during rolling of the next and subsequent passes.

(9) In some embodiments, in the above configuration (8), the rolling condition decision part is configured to decide whether to perform rolling of the next pass of the metal plate by the rolling mill apparatus on the basis of a size of the edge crack of the metal plate detected by the edge crack sensor.

With the above configuration (9), by deciding whether to perform rolling of the next pass on the basis of the size of the detected edge crack, it is possible to suppress growth of an edge crack and plate breakage during rolling of the next and subsequent passes effectively.

(10) In some embodiments, in the above configuration (8), the rolling condition decision part is configured to decide a timing to change the rolling condition during rolling of the next pass of the metal plate by the rolling mill apparatus on the basis of a position, in a longitudinal direction of the metal plate, of the edge crack of the metal plate detected by the edge crack sensor.

With the above configuration (10), by deciding the timing to change the rolling condition during rolling of the next pass on the basis of the position of the detected edge crack in the longitudinal direction of the metal plate, it is possible to suppress growth of an edge crack during rolling while suppressing deterioration of the production efficiency.

(11) According to at least one embodiment of the present invention, a rolling mill facility includes: a rolling mill apparatus including at least one rolling mill stand for rolling a metal plate; an edge crack sensor configured to detect an edge crack at an end portion of the metal plate in a plate width direction during rolling by the rolling mill apparatus; and the control device according to any one of the above (1) to (10) configured to control the rolling mill apparatus on the basis of a detection signal from the edge crack sensor.

With the above configuration (11), the rolling condition for the rolling mill apparatus is changed to a rolling condition that is capable of suppressing growth of an edge crack (second rolling condition) in response to detection of an edge crack at an end portion of the metal plate in the plate width direction, and thus it is possible to suppress growth of an edge crack during rolling or plate breakage due to growth of an edge crack.

(12) In some embodiments, in the above configuration (11), the edge crack sensor includes: a radiation generation part configured to generate radiation toward the end portion of the metal plate; and a radiation detection part disposed at an opposite side to the radiation generation part across the metal plate and configured to receive the radiation from the radiation generation part.

The vicinity of work rolls of a rolling mill stand is often a harsh environment where rolling mill oil and fume scatter in large quantity, the work rolls vibrate, and the place is dark, for instance. In this regard, with the above configuration (12), a radiation generation part and a radiation detection part are included and an edge crack sensor which detects an edge crack by using radiation is used, and thus it is possible to detect an edge crack in the vicinity of work rolls under a harsh environment.

(13) According to at least one embodiment of the present invention, a method of operating a rolling mill apparatus including at least one rolling mill stand includes: a step of rolling a metal plate using the rolling mill apparatus; a step of detecting an edge crack at an end portion of the metal plate in a plate width direction during rolling by the rolling mill apparatus; and a step of changing, if the edge crack of the metal plate is detected, a rolling condition for the rolling mill apparatus from a first rolling condition immediately before detection of the edge crack to a second rolling condition which is more capable of suppressing growth of the edge crack than the first rolling condition.

According to the above method (13), the rolling condition for the rolling mill apparatus is changed to a rolling condition that is capable of suppressing growth of an edge crack (second rolling condition) in response to detection of an edge crack at an end portion of the metal plate in the plate width direction, and thus it is possible to suppress growth of an edge crack during rolling or plate breakage due to growth of an edge crack.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Rolling mill facility
2 Rolling mill apparatus
4 Unwinder
6 Input-side pinch roll
7 Upstream side stand
9 Downstream side stand
10 Rolling mill stand
10A Rolling mill stand
10B Rolling mill stand
10C Rolling mill stand
10D Rolling mill stand
11 Motor
12 Output-side pinch roll
14 Rewinder
15 Work roll
16 Work roll
17 Intermediate roll
18 Intermediate roll
19 Backup roll
20 Backup roll
22 Rolling reduction device
23 Roll bender
24 Heater
26 Shift cylinder
30 Edge crack sensor

32 Radiation generation part
34 Radiation detection part
50 Control device
52 Detection signal acquisition part
54 Rolling condition decision part
56 Control part
E Plate edge
S Metal plate

The invention claimed is:

1. A control device for a rolling mill apparatus including at least one rolling mill stand for rolling a metal plate, the control device including:

a detection signal acquisition part for receiving, from an edge crack sensor, a detection signal of an edge crack at an end portion of the metal plate in a plate width direction; and a rolling condition decision part for deciding a rolling condition for the rolling mill apparatus, wherein the rolling condition decision part is configured to change, if the detection signal acquisition part receives the detection signal of the edge crack, the rolling condition for the rolling mill apparatus from a first rolling condition immediately before detection of the edge crack to a second rolling condition which is more capable of suppressing growth of the edge crack than the first rolling condition, wherein the rolling condition decision part is configured to maintain the rolling condition for the rolling mill apparatus to the second rolling condition after the detection signal acquisition part receives the detection signal of the edge crack and at least until a portion of the metal plate which includes the edge crack portion is rewound by a rewinder of the rolling mill apparatus, and wherein the rolling condition decision part is configured to set the rolling condition for the rolling mill apparatus back to the first rolling condition after the portion of the metal plate including the edge crack is rewound by the rewinder.

2. The control device for a rolling mill apparatus according to claim 1, wherein the rolling condition decision part is configured to reduce, during operation of the rolling mill apparatus under the second rolling condition, an advance speed of the metal plate to be smaller than the advance speed of the metal plate under the first rolling condition.

3. The control device for a rolling mill apparatus according to claim 1, wherein the rolling condition decision part is configured to reduce, during operation of the rolling mill apparatus under the second rolling condition, a tension at an end portion of the metal plate in the plate width direction to be smaller than the tension under the first rolling condition.

4. The control device for a rolling mill apparatus according to claim 1, wherein the at least one rolling mill stand includes an upstream-side stand disposed at an upstream side of a detection position of the edge crack in an advance direction of the metal plate.

5. The control device for a rolling mill apparatus according to claim 1, wherein the rolling mill apparatus is configured to roll the metal plate in a plurality of passes, and wherein the rolling condition decision part is configured to decide the rolling condition for next and subsequent passes among the plurality of passes of the metal plate by the rolling mill apparatus on the basis of the detection result received from the edge crack sensor during rolling by the rolling mill apparatus.

6. The control device for a rolling mill apparatus according to claim 5, wherein the rolling condition decision part is configured to decide whether to perform rolling of the next pass of the metal plate by the rolling mill apparatus on the basis of a size of the edge crack of the metal plate detected by the edge crack sensor.

7. The control device for a rolling mill apparatus according to claim 5, wherein the rolling condition decision part is configured to decide a timing to change the rolling condition during rolling of the next pass of the metal plate by the rolling mill apparatus on the basis of a position, in a longitudinal direction of the metal plate, of the edge crack of the metal plate detected by the edge crack sensor.

8. A rolling mill facility, comprising:

the rolling mill apparatus including the at least one rolling mill stand for rolling the metal plate;

the edge crack sensor configured to detect the edge crack at the end portion of the metal plate in a plate width direction during rolling by the rolling mill apparatus; and the control device according to claim 1 configured to control the rolling mill apparatus on the basis of the detection signal from the edge crack sensor.

9. The rolling mill facility according to claim 8, wherein the edge crack sensor includes:

a radiation generation part configured to generate radiation toward the end portion of the metal plate; and a radiation detection part disposed at an opposite side to the radiation generation part across the metal plate and configured to receive the radiation from the radiation generation part.

10. A control device for a rolling mill apparatus including at least one rolling mill stand for rolling a metal plate, the control device including:

a detection signal acquisition part for receiving, from an edge crack sensor, a detection signal of an edge crack at an end portion of the metal plate in a plate width direction; and a rolling condition decision part for deciding a rolling condition for the rolling mill apparatus, wherein the rolling condition decision part is configured to change, if the detection signal acquisition part receives the detection signal of the edge crack, the rolling condition for the rolling mill apparatus from a first rolling condition immediately before detection of the edge crack to a second rolling condition which is more capable of suppressing growth of the edge crack than the first rolling condition, wherein the at least one rolling mill stand includes an upstream-side stand disposed at an upstream side of a detection position of the edge crack in an advance direction of the metal plate, wherein the at least one rolling mill stand includes a downstream-side stand disposed at a downstream side of the detection position of the edge crack in the advance direction, and wherein the rolling condition decision part is configured to, during operation of the rolling mill apparatus under the second rolling condition:

reduce a tension of an end portion of the metal plate in the plate width direction in a region between the upstream-side stand and the downstream-side stand to be smaller than the tension under the first rolling condition until the edge crack passes through the downstream side stand; and set the tension in the region back to the tension under the first rolling condition after the edge crack passes through the downstream-side stand.

11. A rolling mill facility, comprising:

the rolling mill apparatus including the least one rolling mill stand for rolling the metal plate;

the edge crack sensor configured to detect the edge crack at the end portion of the metal plate in the plate width direction during rolling by the rolling mill apparatus; and the control device according to claim 10 configured to control the rolling mill apparatus on the basis of the detection signal from the edge crack sensor.

12. A method of operating a rolling mill apparatus including at least one rolling mill stand, the method comprising:

a step of rolling a metal plate using the rolling mill apparatus;

a step of detecting an edge crack at an end portion of the metal plate in a plate width direction during rolling by the rolling mill apparatus; and a step of changing, if the edge crack of the metal plate is detected, a rolling condition for the rolling mill apparatus from a first rolling condition immediately before detection of the edge crack to a second rolling condition which is more capable of suppressing growth of the edge crack than the first rolling condition, wherein the at least one rolling mill stand includes an upstream-side stand disposed at an upstream side of a detection position of the edge crack in an advance direction of the metal plate, and wherein the at least one rolling mill stand includes a downstream-side stand disposed at a downstream side of the detection position of the edge crack in the advance direction, and wherein the method comprises a step of, during operation of the rolling mill apparatus under the second rolling condition, reducing a tension of an end portion of the metal plate in the plate width direction in a region between the upstream-side stand and the downstream-side stand to be smaller than the tension under the first rolling condition until the edge crack passes through the downstream side stand, and setting the tension in the region back to the tension under the first rolling condition after the edge crack passes through the downstream-side stand.

* * * * *